US006595491B1

(12) United States Patent
Harmon

(10) Patent No.: US 6,595,491 B1
(45) Date of Patent: Jul. 22, 2003

(54) DEVICE FOR REMOVING/INSTALLING TACKS

(76) Inventor: Lary Harmon, 524 F Via De La Valle, Solana Beach, CA (US) 92075

( * ) Notice: Subject to any disclaimer, the term of this patent is extended or adjusted under 35 U.S.C. 154(b) by 0 days.

(21) Appl. No.: 10/122,810

(22) Filed: Apr. 15, 2002

(51) Int. Cl.[7] ..... B25C 11/00
(52) U.S. Cl. ..... 254/18; 29/270; 29/278
(58) Field of Search ..... 254/18, 20, 29 R, 254/30, 31, 10.5; 29/276, 278

(56) References Cited

U.S. PATENT DOCUMENTS

| | | | | |
|---|---|---|---|---|
| 2,533,112 A | * | 12/1950 | Hayden | 254/18 |
| 3,750,500 A | * | 8/1973 | Peterson | 254/18 |
| 4,482,131 A | * | 11/1984 | Hamilton | 254/18 |
| 4,658,457 A | * | 4/1987 | Rokita | 254/18 |
| 6,015,136 A | * | 1/2000 | Benudiz | 254/18 |

FOREIGN PATENT DOCUMENTS

| | | | | |
|---|---|---|---|---|
| GB | 2226974 A | * | 7/1990 | 254/18 |

* cited by examiner

*Primary Examiner*—Lee D. Wilson
(74) *Attorney, Agent, or Firm*—David B. Waller & Associates

(57) ABSTRACT

The present invention is a tack installation and removal device comprising a body having a top and sides extending from the top forming a cup-shaped internal surface; the top having a round aperture extending therethrough; and the cup-shaped internal surface able to be affixed to a rod; a cap having an upper surface and a depending skirt extending from the upper surface; the upper surface having a keyhole-shaped aperture extending therethrough and generally centered in the upper surface; the cap being affixed to the body such that the larger portion of the keyhole-shaped aperture is aligned with the round aperture in the body the larger portion of the keyhole-shaped aperture and the round aperture able to accept the head of a tack and wherein the narrow portion of the keyhole-shaped aperture is smaller than the head of a tack.

7 Claims, 2 Drawing Sheets

DEVICE FOR REMOVING/INSTALLING TACKS

TECHNICAL FIELD

The present invention relates to tools used in party preparation or decoration. In particular a device for removing and installing tacks.

BACKGROUND OF THE INVENTION

A number of devices have been described for driving tacks, nails and rivets that hold the tack, nail or rivet securely within the device for installation. U.S. Pat. No. 2,929,067 to F. A. Tupta describes a chuck and driver for holding and driving a tack. This device comprises a handle and a chuck assembly for holding a thumbtack. The chuck assembly comprises an anvil contoured to match the top surface of the thumbtack. The anvil is surrounded by resilient fingers for gripping the thumbtack and the fingers are surrounded by a cylindrical shield having sufficient clearance to allow outward movement of the resilient fingers when receiving the head of a thumbtack. Unfortunately, this device is specific for flat headed thumbtacks and can only drive them into a surface. It does not have the ability to remove the thumbtack once it has been installed.

U.S. Pat. No. 1,867,928 to T. A. Smith describes a device for holding a nail to assist in installation. The device comprises a cylindrical bar adapted for hammer impact on one end and a recess on the other end adapted to accept a nail head. A plate slide is mounted on the bar having a finger pull on one end and a forked prong on the other end. The forked prong is adapted to hold a nail within the recess of the cylindrical bar. Unfortunately, this device is specific for nails and can only install them. This device does not have the ability to remove the nail once it has been installed. In addition, this device requires hand positioning for setting a nail. Consequently, injury could result when driving a nail if the driving tool misses its intended target or slips off the cylindrical bar upon impact.

U.S. Pat. No. 3,847,193 to F. H. Brunstetter also describes a device for holding a nail to assist in installation. The device comprises a tool-engaging portion having a trailing end that receives the blows of a driving tool such as a hammer and a leading end adapted to accept a nail. A fastener-head receiving member is secured to the leading end of the tool-engaging portion. The fastener-head receiving member comprises a flexible membrane having a self-closing opening for the insertion of a fastener or nail. While this device is not specific for a particular fastener (i.e. nail, tack or rivet) it does not have the ability to remove the fastener once it has been installed. In addition, this device requires hand positioning of the device for setting a fastener. Consequently, injury could result when driving a nail or tack if the driving tool misses its intended target or slips off the trailing end of the tool-engaging portion upon impact.

U.S. Pat. No. 1,500,253 to F. A. Miller describes a rivet holding and setting tool that comprises a tubular body a rivet-head seat at one end of the body and a plunger cooperating with the rivet-head seat. The rivet-head seat is adapted to receive a marginal portion of the rivet head to secure the rivet in the device. Unfortunately this device is specific for rivets and can only install them. This device does not have the ability to remove the rivet once it has been installed. In addition this device requires hand positioning for setting a rivet. Consequently, injury could result when driving a rivet if the driving tool misses its intended target or slips off the tubular body upon impact.

Therefore, there is a need for a fastener-installing device that is safe and has the ability to remove the fastener once it has been installed. In particular, there is a need for a tack-installing device that allows the user to remove the tack once it has been installed and does not require the impact of a driving tool such as a hammer.

SUMMARY OF THE INVENTION

In one embodiment the present invention provides a tack installation and removal device comprising a body having a top and sides extending from the top forming a cup-shaped internal surface; the top having a round aperture extending therethrough; and the cup-shaped internal surface able to be affixed to a rod such that the space between the top and the rod is not less than one-sixteenth inch and not more than three-sixteenth inch; a cap having an upper surface and a depending skirt extending from the surface forming a cavity; the cavity able to accept the body; the upper surface having a keyhole-shaped aperture extending therethrough and generally centered in the upper surface; the cap being affixed to the body such that the larger portion of the keyhole-shaped aperture is aligned with the round aperture in the body and such that the space between the top and the upper surface is not less than about one-sixteenth inch and not more than about one-fourth inch; the larger portion of the keyhole-shaped aperture and the round aperture able to accept the head of a tack and wherein the narrow portion of the keyhole-shaped aperture is smaller than the head of a tack.

In one aspect of this embodiment the cap maybe rotatably affixed to the body such that when rotated the larger portion of the keyhole-shaped aperture can be aligned with the round aperture in the body. The round aperture may further comprise side walls extending parallel to and adjacent to the sides of the top. These side walls may also be tapered.

In another aspect of this embodiment the tack installation and removal device may further comprise a rod and the rod may be adjustable in length.

In yet another embodiment a kit is provided comprising a tack installation and removal device of the present invention, a plurality of tacks and a rod.

In another embodiment of the invention a tack installation and removal device is provided comprising a rod having two ends; a body having a top and sides extending from the top forming a cup-shaped internal surface able to accept the rod; the top having a round aperture extending through the top; and the body affixed to one end of the rod such that the space between the top and the rod is not less than one-sixteenth inch and not more than one-half inch; and a cap having an upper surface and a depending skirt extending from the surface forming a cavity able to accept the rod; the upper surface having a keyhole-shaped aperture extending through and generally centered in the upper surface; the cap affixed to the rod such that the upper surface is not less than about one-sixteenth inch and not more than about one-fourth inch from the rod; wherein the larger portion of the keyhole-shaped aperture and the round aperture are able to accept the head of a tack and wherein the narrow portion of the keyhole-shaped aperture is smaller than the head of tack.

In one aspect of this embodiment the round aperture may further comprise side walls extending parallel to and adjacent to the sides of the top and may be tapered.

In another aspect of this embodiment the rod may be adjustable in length.

DETAILED DESCRIPTION

Figure 1:
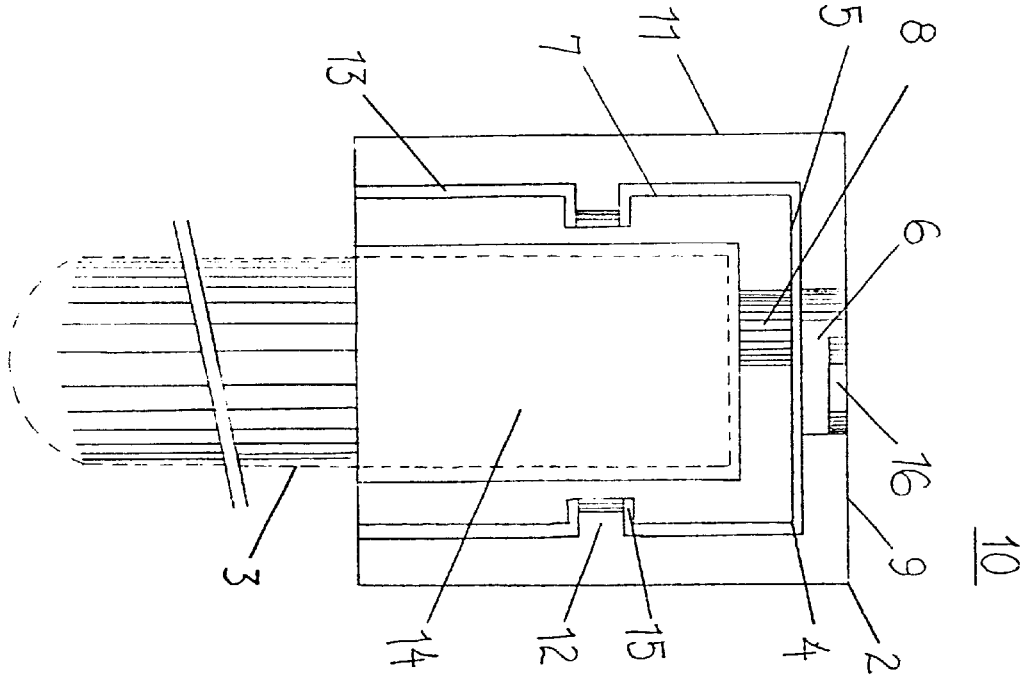
FIG. 1: Is a diagrammatic representation of one embodiment of the present invention wherein the installing and removing elements are combined on one end of a rod showing cross-sectional a side view (A) and a top view (B).
Figure 1:
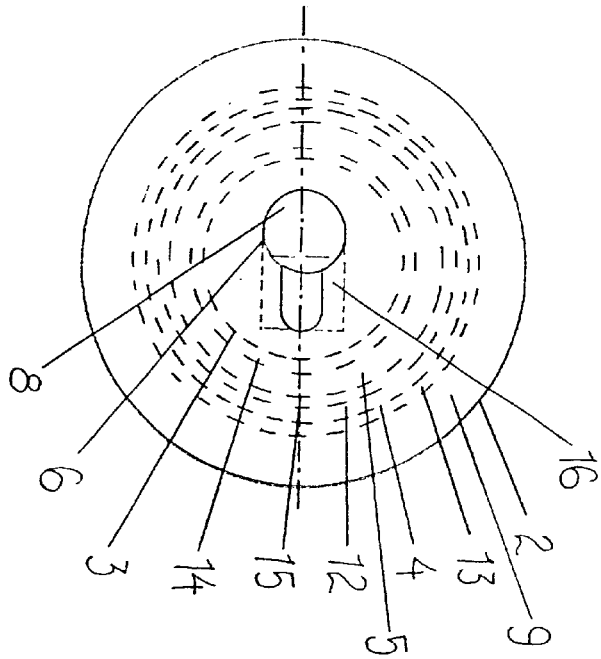
Figure 2:
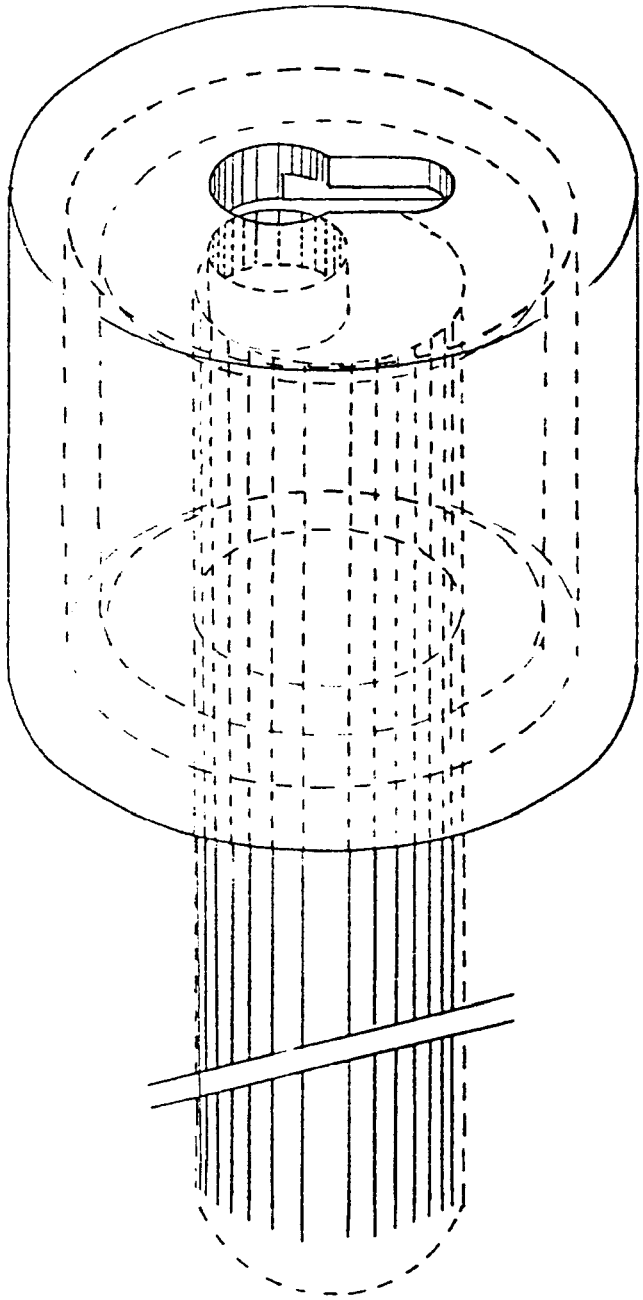
FIG. 2: Is a perspective view of the present invention wherein the installing and removing elements are combined on one end of a rod.

Unless defined otherwise, all terms used herein have the same meaning as is commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The term "tack" as used herein refers to any fastener having a ridged shaft wherein one end is tapered to a point for penetrating a surface and the other end having a head for driving the tapered point into a surface by hand and without the need for a driving tool such as a hammer (e.g. a thumbtack or push pin).

The term "adapter" or "adapters" as used herein refers to a means for affixing one element of the invention to another by a variety of methods known to those skilled in the art such as for example, the cap may be secured to the body by a snap fit adapter.

The present invention contemplates a variety of device constructions including the device 10 affixed to a rod 3 wherein both installation and removal elements are on one end of the rod or wherein the installation element and the removal elements are affixed on opposite ends of a rod 3. Other constructions include a device 10 wherein the removal element and installation element are provided in fixed positions either side by side or one on top of the other wherein the circular aperture 8 is positioned below the keyhole-shaped aperture 6, wherein one element is provided as a removable cap that fits over the other element, or wherein one element is rotatably affixed on top of the other element. In all constructions the device is adapted to accept a handle, a fixed length rod or an extendable rod. The device may also be utilized with or without a handle or rod.

In one preferred embodiment the installation and removal elements may be affixed on one end of a rod 3. In this configuration the device 10 is comprised of a body 4 having a top 5 and sides 7 extending from the top 5 forming a cup-shaped internal 14 surface and a cap 2 having an upper surface 9 and a depending skirt 11 extending from the upper surface 9 forming a cavity 13 able to accept the body 4. The top 5 of the body 4 has a round aperture 8 extending there through and the upper surface 9 of the cap 2 has a keyhole-shaped aperture 6 generally centered in the upper surface 9 and extending there through. The cap 2 is affixed to the body 4 aligning the larger portion of the keyhole-shaped aperture 6 with the round aperture 8 in the body 4 and the cup-shaped internal surface 14 may be affixed to a rod 3.

A. The Body

The body 4 of the device 10 may be provided in a variety of shapes including round tube-shaped, oval tube-shaped, square-box, rectangular-box, a free-formed shape, an irregular shape or any combination of these shapes. Preferably the shape is round or oval tube-shaped. The length of the sides 7 of the body 4 will depend on the height desired for use. Preferably the length of the sides 7 may be not less than ½ inch to not more than 36 inches, most preferably the length is not less than 4 inch and not more than 35 inches. The diameter of the top 5 of the body 4 will depend on the size desired for use. Preferably the diameter is not less than ¾ inch and not more than 2 inches in the longest dimension. Preferably the diameter of the top 5 is not less than 1 inch and not more than 1½ inches. Most preferably the diameter is about 1 inch. The thickness of the sides 7 and top 5 may be any thickness desired for, strength during use. They may be the same or different and are preferably not less than 1/16 inch and not more than ⅜ inch. Preferably the thickness is not less than ⅛ inch and not more than ¼ inch. Most preferably the thickness of the sides 7 are about ¼ inch and the top 5 is about ½ inch. The body 4 may be constructed of a variety of materials known to those skilled in the art including polymer plastic, high-density polymer, wood or metal. Preferably the body 4 is made of a polymer such as polyvinylchloride.

The sides 7 of the device 10 that extend from the top 5 of the body 4 create the cup-shaped internal surface 14. This surface may be provided in a variety of configurations known to those skilled in the art for allowing the body 4 to be affixed securely to a rod 3. For example, the walls of the internal surface 14 may be parallel or tapered from the opening to the base of the cup and the surface may be smooth or textured for press fitting onto a rod 3. In other examples, the internal surface 14 may be provided with threads so that the body may be screwed onto a rod 3, the internal surface 14 may be provided with adapters that allow the body 4 to be snapped into place on a rod 3 or one portion of a Velcro™ strip may be attached to the base of the cup-shaped internal surface 14 and the other portion of the Velcro™ strip attached to the tip of the rod 3 or a magnet may be attached to the base of the cup-shaped internal surface 14 and an oppositely charged magnet attached to the top of the rod 3. Alternatively, the device may be affixed to the rod 3 by a screw or pin inserted through the body 4 perpendicular to the length of the rod 3.

The exterior surface of the sides 7 may be provided with means to allow the cap 2 to be secured to the body 4 in a stationary position such as with a clip or snap, removably such as with threads or by press-fitting, or rotatably such as with a groove 15 or track. The cap 2 may also be more permanently adhered to the body 4 by a variety of methods known to those in the art including adhesive.

The round aperture 8 in the top 5 of the body 4 is preferably positioned off center for alignment with the keyhole-shaped aperture 6 when the keyhole-shaped aperture 6 is provided on the cap 2. The diameter of the round aperture 8 is preferably not less than the diameter of the head of a tack that the user intends to install or remove. More particularly, the diameter is not less than ⅜ inch and not more than ½ inch. Preferable if the tack is a push-pin the diameter is not less than 7/16 inch and not more than ⅝ inch. Preferably the diameter is about ½ inch. When the tack is a thumbtack the diameter is not less than ⅜ inch and not more than ½ inch. Preferably the diameter is about ⅜ inch.

Depending on the thickness of the top 5, the round aperture 8 that would accept a tack may have a depth not less than 1/16 inch and not more than ½ inch. If the tack is a push-pin the preferred depth is not less than ¼ inch and not more than ½ inch. If the tack is a thumbtack the preferred depth is not less than 1/16 inch and not more than ⅛ inch. The walls created by the thickness of the top 2 may be parallel, tapered from the top 2 of the body 4 to the base of the aperture walls, or may have a contour similar to that of the tack, for example the contour of a push-pin that will allow the push-pin to be removably placed within the round aperture 8.

In another preferred embodiment the installation element and the removal element are provided on the body 4 positioned side by side. In this configuration the body 4 further comprises a keyhole-shaped aperture 6 placed side by side with the round aperture 8. The keyhole-shaped aperture 6 has a larger circular portion and an elongated portion extending perpendicular to the diameter of the circular portion. The diameter of the circular portion is preferably not less than the diameter of the head of a tack that the user intends to install or remove. More particularly, the diameter is not less than ⅜ inch and not more than ½ inch. Preferable if the tack is a push-pin the diameter is not less than 7/16 inch and not more than ⅝ inch. Preferably the diameter is about ½ inch. When the tack is a thumbtack the diameter is not less than ⅜ inch and not more than ½ inch. Preferably the diameter is about ⅜ inch. The shortest dimension of the elongated portion is preferably not less than the shaft of the tack and not more than the head of the tack. Most preferably the shortest dimension of the elongated portion is not less than 1/16 inch and not more than 3/16 inch. The diameter of the opening below the elongated portion of the keyhole-shaped aperture 6 is the same as the diameter of the larger circular portion. The ridges 16 that form the elongated portion are of a thickness not less than 1/16 inch and not more than ½ inch. When the tack being removed is a thumbtack the thickness of the elongated portion ridges 16 is preferably about 1/16 inch. When the tack is a push-pin the thickness of the elongated portion ridges 16 is preferably not less than ⅛ inch and not more than 3/16 inch.

One skilled in the art could contemplate other configurations of the apertures that would allow more efficient use of the device. For example, the area on either side of the larger circular portion of the keyhole-shaped aperture 6 where the elongated portion intersects the circular portion could be tapered to allow the user to better position these areas between the surface and the tack for more efficient removal.

In yet another embodiment the installation element and removal element are provided on the body 4 and positioned one within the other. More particularly, the circular portion of the keyhole-shaped aperture 6 is adapted to accept a tack for installation and accept the head of the tack for removal. In this configuration the tack may be inserted into the larger circular portion of the keyhole-shaped aperture 6 for installation. Correspondingly, the head of an already installed tack may be inserted into the larger circular portion and by moving the elongated portion under the head of the tack the user may remove the tack by pulling.

B. The Cap

The cap of the device may be provided in a variety of shapes including round tube-shaped, oval tube-shaped, square-box, rectangular-box, a free-formed shape, an irregular shape or any combination of these shapes. Preferably the shape is similar to or adaptable to the body 4 of the device 10 so that the cap 2 may be affixed to the body 4. The length of the depending skirt 11 may be similar to, longer than or shorter than the length of the sides of the body. Preferably the cap 2 is not less than ¾ inch and not more than 35 inches, most preferably the length is not less than 1 inch and not more than 3 inches. The diameter of the upper surface 9 of the cap 2 is larger than the top 5 of the body 4 and is preferably not less than 1 inch and not more than 2¼ inches in the longest dimension. Most preferably the diameter is about 1¼ inch. The thickness of the depending skirt 11 and upper surface 9 may be the same or different and are preferably not less than 1/16 inch and not more than ⅜ inch. Preferably the thickness is not less than ⅛ inch and not more than ¼ inch. Most preferably the thickness of the depending skirt 11 are about ¼ inch and the upper surface is about ½ inch. The cap 2 may be constructed of a variety of materials known to those skilled in the art including polymer plastic, high-density polymer or metal. The cap may be made of the same material as the body or a different material.

The depending skirt 11 of the device 10 that extends from the upper surface 9 of the cap 2 forms a cavity 13. This cavity 13 may be provided in a variety of configurations known to those skilled in the art for allowing the cap 2 to be affixed to the body 4. For example, the walls of the cavity 13 may be parallel or tapered and may be smooth or textured for press fitting onto a body 4. The cavity 13 may also be provided with threads so that the cap 2 may be screwed onto a body 4 or may be provided with adapters that allow the cap 2 to be snapped into place on the body 4 or may have a groove ridge 12 that fits into a corresponding groove 15 or track on the side of the body 4 that allows the cap 2 to be rotatably affixed to the body 4. The cap 2 may also be more permanently adhered to the body 4 by a variety of methods known to those in the art including adhesive.

The keyhole-shaped aperture 6 is generally centered in the upper surface 9 of the cap 2 for alignment with the round aperture 8 on the body 4. The keyhole-shaped aperture 6 has a larger circular portion and an elongated portion extending perpendicular to the diameter of the circular portion. The diameter of the circular portion is preferably not less than the diameter of the head of a tack that the user intends to install or remove. More particularly, the diameter is not less than ⅜ inch and not more than ½ inch. Preferable if the tack is a push-pin the diameter is not less than 7/16 inch and not more than ⅝ inch. Preferably the diameter is about ½ inch. When the tack is a thumbtack the diameter is not less than ⅜ inch and not more than ½ inch. Most preferably the diameter is about ⅜ inch. The shortest dimension of the elongated portion is preferably not less than the shaft of the tack and not more than the head of the tack. Most preferably the shortest dimension of the elongated portion is not less than 1/16 inch and not more than 3/16 inch. The diameter of the opening below the elongated portion of the keyhole-shaped aperture 6 is the same as the diameter of the larger circular portion. The ridges 16 that form the elongated portion are of a thickness not less than 1/16 inch and not more than ½ inch. When the tack being removed is a thumbtack the thickness of the elongated portion ridges 16 is preferably about 1/16 inch. When the tack is a push-pin the thickness of the elongated portion ridges is preferably not less than ⅛ inch and not more than 3/16 inch.

One skilled in the art could contemplate other configurations of the apertures that would allow more efficient use of the device. For example, the area on either side of the larger circular portion of the keyhole-shaped aperture 6 where the elongated portion intersects the circular portion could be tapered to allow the user to better position these areas between the surface and the tack for more efficient removal.

In another preferred embodiment the body 4 and the cap 2 are affixed on different ends of a rod 3. In this configuration the walls of the cavity 13 may be provided with means for allowing the cap 2 to be affixed securely to a rod 3 similar to that described for the body 4. For example, the walls of the cavity 13 may be parallel or tapered and the surface may be smooth or textured for press fitting onto a rod 3. Alternatively, the cavity 13 may be provided with threads so that the cap 2 may be screwed onto a rod 3. The walls of the cavity 13 may also be provided with adapters that allow the cap 2 to be snapped into place on a rod 3 or one portion of a Velcro™ strip may be within the cavity 13 and the other portion of the Velcro™ strip attached to the end of the rod 3.

I claim:

1. A tack installation and removal device comprising:

a body having a top and sides extending from said top forming a cup-shaped internal surface;

said top having a round aperture extending through said top; and said cup-shaped internal surface able to be affixed to a rod such that the distance between said top and said rod is not less than one-sixteenth inch and not more than three-sixteenth inch;

a cap having an upper surface and a depending skirt extending from said upper surface forming a cavity;

said cavity able to accept said body;

said upper surface having a keyhole-shaped aperture extending through and generally centered in said upper surface;

said cap being rotatably and removably affixed to said body such that when rotated a larger portion of said keyhole-shaped aperture is aligned with said round aperture in said body and such that the distance between said top and said upper surface is not less than about one-sixteenth inch and not more than about one-fourth inch;

said larger portion of said keyhole-shaped aperture and said round aperture able to accept a tack head and wherein a narrow portion of said keyhole-shaped aperture is smaller than said tack head.

2. The tack installation and removal device according to claim 1 wherein said round aperture further comprises side walls extending parallel to and adjacent to said sides of said top.

3. The tack installation and removal device according to claim 2 wherein said side walls are tapered.

4. The tack installation and removal device according to claim 1 further comprising said rod.

5. The tack installation and removal device according to claim 1 wherein said rod is adjustable in length.

6. The tack installation and removal device according to claim 4 wherein said body is placed on one end of said rod and said cap is placed on the other end of said rod.

7. A kit comprising a tack installation and removal device comprising:

a body having a top and sides extending from said top forming a cup-shaped internal surface;

said top having a round aperture extending through said top;

said cup-shaped internal surface able to be affixed to a rod such that a space between said top and said rod is not less than one-sixteenth inch and not more than three-sixteenth inch;

a cap having an upper surface and a depending skirt extending from said surface forming a cavity;

said cavity able to accept said body;

said upper surface having a keyhole-shaped aperture extending through and generally centered in said upper surface wherein said keyhole-shaped aperture has a larger portion and a narrow portion;

said cap being rotatably and removably affixed to said body such that when rotated a larger portion of said keyhole-shaped aperture can be aligned with said round aperture in said body and such that a space between said top and said upper surface is not less than about one-sixteenth inch and not more than about one-fourth inch;

said larger portion of said keyhole-shaped aperture and said round aperture able to accept a tack head and wherein said narrow portion of said keyhole-shaped aperture is smaller than said tack head;

a rod; and a plurality of tacks.

* * * * *